US006142112A

United States Patent [19]

Leijonberg

[11] Patent Number: 6,142,112

[45] Date of Patent: Nov. 7, 2000

[54] SPARKING DEVICE

[75] Inventor: Gunnar Leijonberg, Huskvarna, Sweden

[73] Assignee: Gul & Co Development AB, Jonkoping, Sweden

[21] Appl. No.: 09/329,348

[22] Filed: Jun. 10, 1999

Related U.S. Application Data

[63] Continuation of application No. PCT/SE97/02144, Dec. 18, 1997.

[30] Foreign Application Priority Data

Dec. 23, 1996 [SE] Sweden ..... 9604838-4

[51] Int. Cl.[7] ..... F02B 75/28; F02P 15/00

[52] U.S. Cl. ..... 123/51 R; 123/169 EL; 123/169 EA

[58] Field of Search ..... 123/169 EL, 169 EA, 123/169 EC, 146.5 R, 51 R

[56] References Cited

U.S. PATENT DOCUMENTS 1,129,086 2/1915 Gould ..... 123/51 R
1,542,504 6/1925 Heide ..... 123/169 EC

FOREIGN PATENT DOCUMENTS 499549 11/1954 Italy ..... 123/169 EC
613497 9/1979 Switzerland .

OTHER PUBLICATIONS

Patent Abstracts of Japan, abstract of JP 63–176628 A (Shigeyoshi Karasawa), Jul. 20, 1988.

*Primary Examiner*—Andrew M. Dolinar
*Attorney, Agent, or Firm*—Pillsbury Madison & Sutro LLP

[57] ABSTRACT

The present invention is for a new kind of sparking device. It is especially suitable for counterstroke engines in which two pistons are working against each other in a common cylinder bore. The invention is for a sparking device for combustion engines which makes it possible to change the distance between the electrodes of the sparking device both with a stopped engine and during operation. The invention also makes it possible to position the sparking device in the center of the cylinder bore and combustion space. The two electrodes are mounted separated from each other in the cylinder wall so that they are opposite to each other and have their centre axis essentially aligned with each other. A linear displacement of one of the electrodes thus means that the distance between the tips (14, 15) of the electrodes is changed.

5 Claims, 3 Drawing Sheets

SPARKING DEVICE

This is a continuation International Appln. No. PCT/SE97/02144 filed Dec. 18, 1997.

BACKGROUND OF THE INVENTION

The present invention is for a new kind of ignition sparking device which replaces conventionally designed spark plugs. The device is especially suitable for the kind of combustion engines which are named counterstroke engines having two pistons which work against each other in a common cylinder bore.

In some kinds of combustion engines there are used sparking devices having two electrodes between which there is a discharge, once during each working cycle. One electrode can be directly connected to the engine block while the other electrode is insulated from the engine block. The two electrodes are made from metal and special alloys have been developed for this purpose. A spark plug of conventional design is inserted into the cylinder through a threaded hole especially made for this purpose. One electrode is usually designed as a straight pin through an insulating body while the other electrode protrudes from a metallic housing around the insulated body so that the tip of the second electrode extends below and beyond the first electrode.

There are several factors which influence the function of the sparking device and the combustion process. Such factors which are directly connected to the design of the sparking device are the distance between the electrodes in the area of discharge and the position of the electrodes in the combustion space especially in relation to the top of the pistons at each occasion of combustion. Other factors are the temperature of operation of the engine and the composition of the fuel air mixture. Various conditions in this respect give rise to different requirements from the sparking device and the design of these which is finally chosen is at least in some respects a compromise between different requirements.

During the operation of the combustion engine the sparking device wears which appears as an increasing distance between the most adjacent parts of the electrodes in the so called spark gap. This causes a continues change of the conditions of operation and after a certain time the sparking device has to be dismounted and adjusted or exchanged. It is not possible to adjust the spark gap of conventional spark plugs during operation. The possibilities of adjustment are limited thereby that the electrodes extend in directions which are essentially at right angle to each other. Changes in the conditions of the operation means that these will not remain optimum for example from an environmental point of view or regarding the efficiency and capacity of the engine.

SUMMARY OF THE INVENTION

The present invention makes it possible to position the sparking device in the centre of the cylinder bore and combustion space or in any other suitable position in order to obtain optimum operation and functioning conditions. In counterstroke engines it is not possible to mount the sparking device parts from either side of the cylinder. The device according to the invention can be mounted from one side only and mounting is through only one opening. This opening is preferably intended for mounting of one part of the sparking device and suitably it has an inside thread for this purpose. The tools which are needed for making a hole in the opposite side of the cylinder wall, which preferably is not a throughbore bore but has a bottom, are introduced through this bore. In this bore one, preferably the fixed, part of the sparking device vice is mounted. This part can easily entirely be made with such dimensions that it without difficulty can be introduced through a bore which is intended for mounting of the second movable sparking device part which is thereafter mounted.

In further embodiments of the invention the spark gap may be positioned non-symmetrically inside the cylinder, for example displaced from the centre axis of the cylinder. One reason for choosing such an embodiment can be to obtain an optimum position of the spark gap in consideration of the gas flow inside the cylinder in order to obtain a rapid flame expansion at combustion. The electrodes can also be designed in a way which in itself affects the gas flow inside the cylinder. The electrodes may then be designed as strips which also may overlap each other as shown in FIG. 4. In other embodiments the surface of the electrode may be designed in a way which controls the gas flow and increases the turbulence in the gas.

These and other advantages are obtained by the features which according to claim 1 characterise the invention.

The device according to the invention will below be described more in detail with reference to the embodiments which are shown in the enclosed figures.

DETAILED DESCRIPTION

Figure 4:
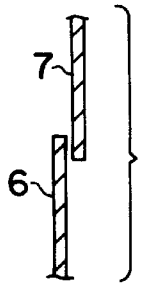
FIGS. 4 and 5 show parts of electrodes of various embodiments closest to the spark gap.
Figure 5:
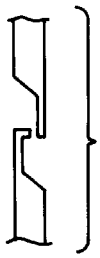

In an engine block 1 there is a cylinder bore 2 in which two pistons 3, 4 having respective piston rods 16, 17 are working. The pistons are working against each other which means that both pistons arrive at their upper dead centre at the same time at which moment the volume between them is at minimum during the cycle of operation. In the figures the pistons are shown in this position. In this kind of combustion engine the pistons thus have a common cylinder bore and a common combustion space in which a sparking device is positioned. The sparking device has two electrodes, in the figures shown as one lower electrode 6 and one upper electrode 7. The two electrodes are mounted separated from each other in the cylinder wall so that they are opposite to each other and have their centre axis essentially in line with each other. Preferably the electrodes are made as pins with circular cross-sections. A linear displacement of one of the electrodes thus means that the distance between the tips 14, 15 of the electrodes, the so called spark gap, is changed. In order to enable such change of the adjustment of the sparking device one electrode 6 is fixedly mounted while the other electrode 7 is movable. Preferably the other, upper electrode is, around that part which passes through the engine block 1, at least partly surrounded by an insulating housing 8 and this or a surrounding outer housing 9 are by means of a thread screwed into the engine block. By turning this part of the sparking device around its axis it is displaced in the engine block and the distance between the electrode tips is changed. The design of the electrodes as straight pins positioned in line with each other means that there are great possibilities of adjustments. In certain applications however the electrodes are of another design as shown in FIGS. 4 and 5.

Preferably the electrode which is insulated from the engine block is mounted so as to be movable. The other electrode shall be in very good conductive contact with the engine block, and this can be difficult to achieve if the electrode is movable and the transition resistance in the contact surface can be supposed to vary in an uncontrollable way.

Figure 1:
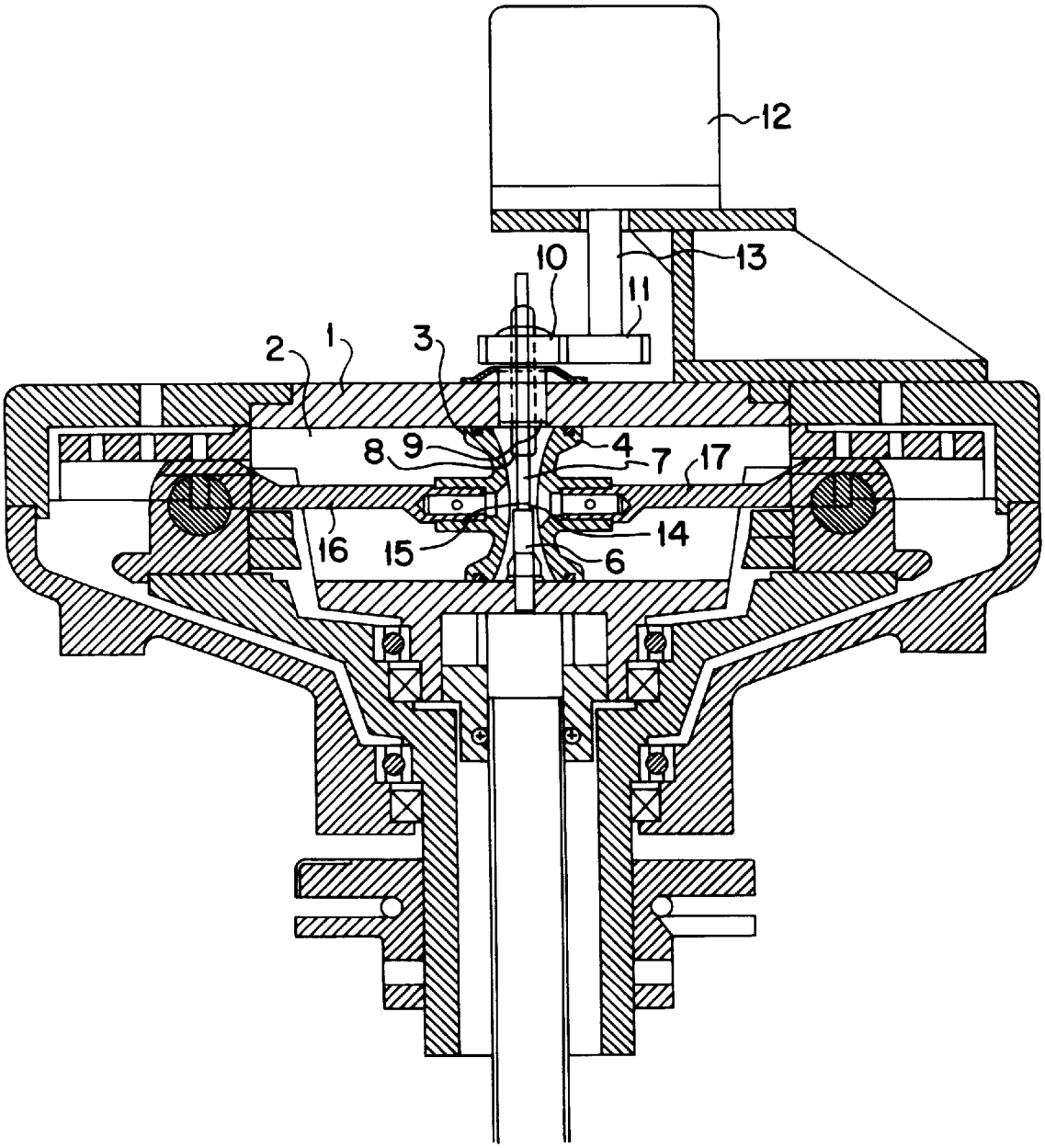
FIG. 1 shows a cross-section of a part of a combustion engine having a sparking device according to the invention.

The movable electrode may be connected to a device for turning of the electrode as shown in the figures. In the embodiment which is shown in FIG. 1 there is a cog-wheel 10 fixedly mounted to the upper electrode 7 outside the engine block. A second cog-wheel 11 is meshing with the first cog-wheel 10, the second cog-wheel being mounted onto the outgoing shaft 13 from a servomotor 12. The servomotor is controlled by signals from a controlling and monitoring system, the detailed design of which is outside the scope of this invention. Signals can be transmitted to the controlling system which indicate the conditions of operation of the engine in every moment and control the distance between the electrodes of the sparking device so that there always are optimum conditions of operation.

Figure 2:
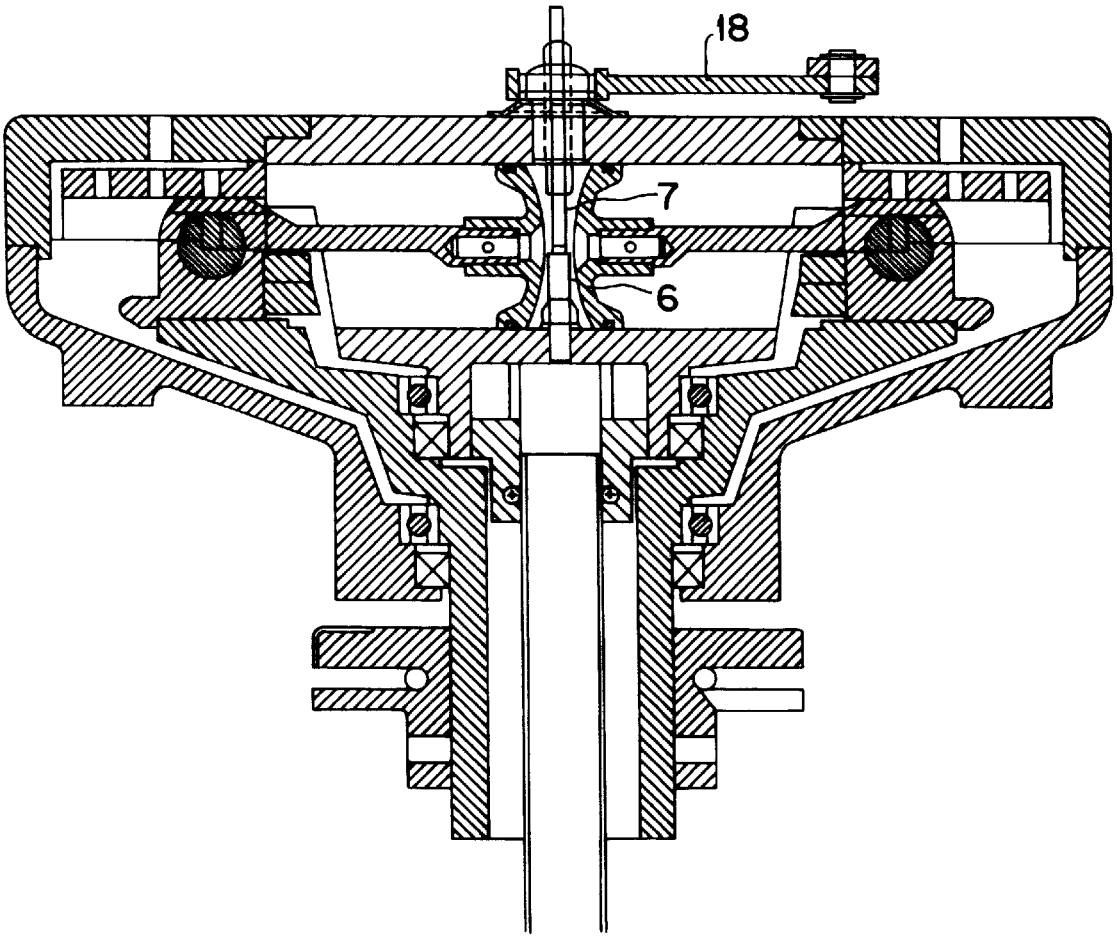
FIG. 2 shows a cross-section of another embodiment of the invention.
Figure 3:
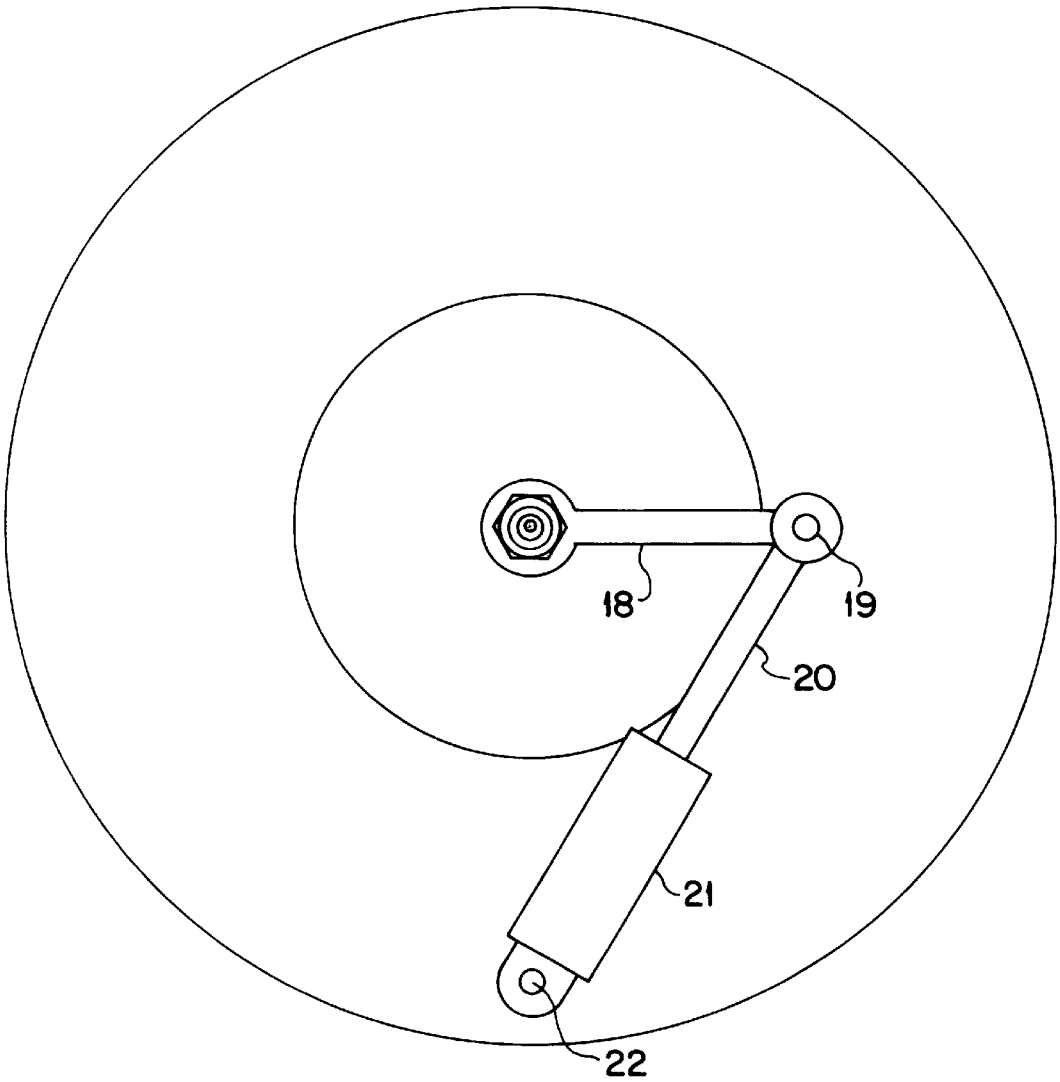
FIG. 3 shows in principle a control means for use by the invention.

Another embodiment of the controlling device is shown in FIGS. 2 and 3. In this case an arm 18 is fixedly mounted to the electrode 7 instead of the cog-wheel of the embodiment described above. The arm 18 is by means of a connection 19 movably connected to the plunger 20 of an hydraulic, electric or pneumatic cylinder 21 which by means of a pivot 22 is movably attached to the engine block or another part of the design which is firmly connected thereto. Also in this case the movements of the arm 18 are controlled by means of a controlling and monitoring system so that there is always an optimum distance between the electrode tips 14, 15.

The invention has above been described with reference to embodiments for a specific kind of combustion engines. It is within the frame of the inventive idea to adapt the invention so that it can be applied also to other kinds of combustion engines.

It is also within the frame of the inventive idea to modify the invention in different ways. The two electrodes may in some cases be positioned with their centre axis at a certain angle to each other. The electrodes may also be made for examples as pins with different cross-sections or having tubular shapes. The two electrodes of a sparking device may also be of different design.

What is claimed is:

1. An engine comprising:

an engine block having a cylindrical bore formed therein, said cylindrical bore defined by a surrounding cylinder wall;

two mutually opposed pistons operatively disposed within said cylindrical bore for reciprocal movement toward and away from each other through an engine cycle during which said pistons reach their respective top dead center and bottom dead center positions within said cylindrical bore at substantially the same instant;

a first electrode disposed in said cylinder wall with a terminal end thereof projecting into said cylindrical bore, said terminal end of said first electrode being disposed generally between the top dead center positions of said pistons; and a second electrode disposed in said cylinder wall with a terminal end thereof projecting into said cylindrical bore, said terminal end of said second electrode being disposed generally between the top dead center positions of said pistons and being spaced apart from said terminal end of said first electrode thereby defining a spark gap between the terminal ends of said first and second electrodes, said spark gap being located generally at the radial center of said cylindrical bore.

2. The engine according to claim 1, wherein a centre axis of said first electrode is generally aligned with a centre axis of said second electrode.

3. The engine according to claim 2, wherein the movable electrode is electrically insulated from the engine block/cylinder wall.

4. The engine according to claim 1, wherein at least one of said first and second electrodes is movably mounted into the cylinder wall so as to be moveable with respect to the other of said first and second electrodes to permit adjustment of said spark gap.

5. The engine of claim 4, wherein the movable electrode is operatively coupled to a servo motor for effecting automated movement of the movable electrode for providing automated adjustment of said spark gap.

* * * * *